United States Patent [19]

Lesser et al.

[11] 4,149,324

[45] Apr. 17, 1979

[54] GOLF SHOES

[76] Inventors: Les Lesser, 1839 Woodside Rd., Apt. 3, Redwood City, Calif. 94061; Frank R. Washburn, 800 Cortez La., Foster City, Calif. 944404

[21] Appl. No.: 872,011

[22] Filed: Jan. 25, 1978

[51] Int. Cl.[2] ..... A43B 5/00; A43B 19/00

[52] U.S. Cl. ..... 36/127; 36/71

[58] Field of Search ..... 36/127, 71, 43, 44

[56] References Cited

U.S. PATENT DOCUMENTS

| | | | |
|---|---|---|---|
| 2,847,769 | 8/1958 | Schlesinger | 36/127 |
| 3,964,181 | 6/1976 | Holcombe | 36/91 |

*Primary Examiner*—Patrick D. Lawson

*Attorney, Agent, or Firm*—Naylor, Neal & Uilkema

[57] ABSTRACT

A comfortable golf shoe made exclusively for golfers having a negative heel with the edges of the sole of the left shoe rolled outwardly and inwardly and the sole of the right shoe rolled on the inner edge only to promote proper turn and body movement and provide the extra power for the stroke and to prevent movement of the feet within the shoes with appropriate padded shaped portions, preventing callouses and foot damage from the constant weight shifting in making the proper golfing stroke.

8 Claims, 13 Drawing Figures

GOLF SHOES

BACKGROUND OF THE INVENTION

It has been known for several years by professionals, golf instructors and some players that to be an effective golfer one must learn the correct way to make the golfing stroke. The beginning of such a stroke centers around the back swing and the correctness in this portion of the swing is necessary for consistently powerful and accurate golf shots. The back swing importantly includes a turn of the shoulders away from the ball and without swaying or moving the head, but principally the back swing starts literally from the ground up with the feet.

The golf swing which everyone attempts to achieve literally starts from the ground up. The coordinated working of the feet and legs are a very necessary action and must be used to initiate the downswing. The power source is in the feet and legs. In accomplishing the back swing the right foot is moved to bear against the inner edge of the right shoe. This moves the shoulders and the upper portion of the body, but not the head, into position for the down swing using the leverage of the inner edge of the right foot. By the time the club head reaches impact the majority of the weight must have been transferred to the left leg and foot. This clears the left side of the body to enable the completion of the swing toward the target. The swing and the transfer of the weight to the left leg causes the left foot to roll over to the left outer edge on the follow through.

It is an easy thing to properly state the back swing and have the words understood, but one must experience the feel of it in order to know the consequences. The first thing is the address which positions the feet with respect to the ball. In the address the player is set firm on his feet with pressure against the inside of the right foot. In starting the back swing the pressure on the inside of the right foot is maintained. This prevents swaying and leaves the emphasis on the body turn. At the start of the down swing the player is still pushing smoothly but firmly from the inside of the right foot and from this point on is where the real power is developed in the stroke. It is the pressure against the inside of the right foot which gives this power.

At the point of contact with the golf ball on the down swing, the pressure is transferred to the left foot and leg for the follow through, with the pressure being transferred to the outer edge of the left foot finishing with the pressure on the left foot outside edge.

The correct sequence of the entire swing will produce a correct striking of the ball with direction and power.

The golfing shoes currently used and as used for many years in the past, are comfortable walking shoes with cleats or spikes arranged in a standard pattern of eleven spikes, seven on the sole portion and four on the heel. The spikes do not assist in making the stroke other than to make sure that the footing is secure in the flat position. With continued pressure on the inside edge of the right foot only half of the spikes are used. It is apparent that the normal golf shoe does not otherwise assist in making the stroke. It merely prevents slipping. Furthermore, the heels pitch the body forward making comfortable balance difficult in making a swing.

In recent years a golf shoe having a sole from front to rear continuously in one piece shaped to form an arch support and with a low or negative heel have been available. These shoes are distributed by GET-SET of Palm Springs, Cal., as advertised in *Golf Digest* for August 1976. The "GET-SET" shoes show the negative heel as properly positioning the weight on both feet within the shoe, while at the same time supporting the arch of the foot. Even though this type of golf shoe claims that it will help one play golf better, it does not indicate any claim for producing and insuring a proper swing in playing the game. It does however make the important change that one is not playing golf in street shoes with spikes but with shoes made specifically for the game. These shoes are in substantially identical pairs with the customary eleven spikes.

SUMMARY OF THE INVENTION

The golf shoes of the present invention have resulted from a careful study and analysis of the proper golf swing as indicated by the top teachers of golf over the years. While these professionals may differ as to methods and styles, they all agree with the analysis of the golf swing as set forth herein. With these tenets in mind, these shoes provide the means for achieving the proper swing every time with a minimum of effort and awkward concentration, and what is more, without any discomfort or interference with normal walking.

The ease of making a proper swing as stated earlier, needs constant rehearsal. The golf shoes described herein are constant reminders of the requirements of and promote the proper swing and weight transfer in making a golf shot.

So far as is known, no other golf shoes are so devised as to do this particular service and still promote the natural pleasure of walking and playing golf.

While in some one or two instances the negative heel golf shoe is heralded not only for its pleasure to wear but for its assistance in the enjoyment of the game of golf, no attempt has heretofore been made to form a shoe which combines not only comfort and proper balance but also aids and promotes a proper golf swing each time.

Further objects are to provide a construction of maximum simplicity, economy, and ease of manufacture, also such further objects, advantages and capabilities as will fully appear and as are inherently possessed by the device and the invention described herein.

Invention further resides in the combination, construction and arrangement of parts illustrated in the accompanying drawings, and while there is shown therein a preferred embodiment thereof, it is to be understood that the same is merely illustrative of the invention and that the invention is capable of modification and change, and comprehends other details of construction without departing from the spirit thereof or the scope of the appended claims.

BRIEF DESCRIPTION OF THE DRAWINGS

FIG. 3 is similar to FIGS. 1 and 2 but shows the foot position with respect to the down swing and follow through;

DESCRIPTION OF THE PREFERRED EMBODIMENTS

Figure 1:
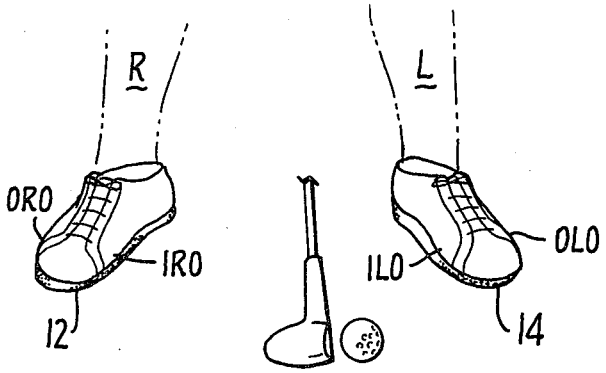
FIG. 1 is a partial front elevation showing the proper address with respect to the feet.

Referring now more particularly to the drawings in which like reference numerals indicate like parts in the several views, it will be observed that the golf shoes 10 have uppers 11 which outwardly appear to be conventionally identical but which in fact have soles 12 and 14 which are made with some variants, 12 representing the right foot and 14 representing the left foot. Each shoe 10 has identically spaced cleats 15 but instead of the usual 11 cleats per shoe, this has 10, 6 cleats being on the main sole portion and 4 cleats being on the equivalent of the heel portion. The sole and heel portions of each shoe are preferably formed in one piece with the heel made as a unitary portion and in what is commonly known as a negative heel, which is substantially on the same horizontal plane, so far as the human foot is concerned, as the ball of the foot.

Figure 5:
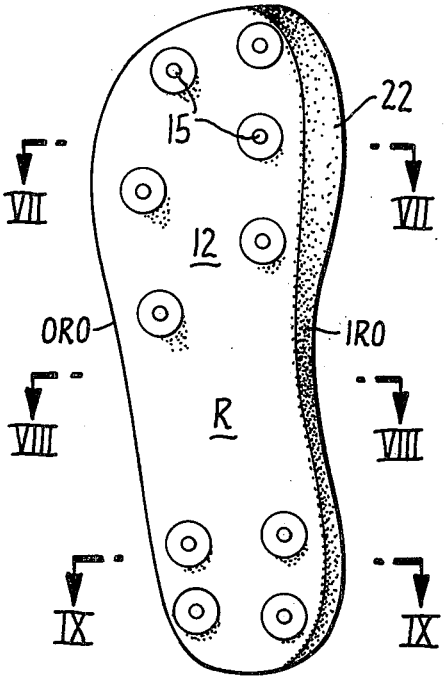
FIG. 5 is a bottom plan view of the sole of the right golf shoe.

Since the left and right shoes are made differently both inside and out, it is necessary to define or identify the portions of each shoe. For example, for purposes of this description the outer surface of the right shoe will be identified ORO representing outer right outside. On the opposite outer surface it will be identified as IRO or inner right outside. As will be seen from the drawings (See FIGS. 5 and 6), the inner right outside faces the inner left outside of the left shoe. The outer surface of the left shoe is entitled OLO for outer left outside. These same identification letters will be used for the description of the inner portion of the shoe, as for example the inner portion of the right shoe will be designated IRI inner right inside, and on the opposite inner portion the inner right inside. The designations for the left shoe follow the same nomenclature. Inside of the left shoe will be designated ILI for the inner left inside and OLI for outer left inside. While this may seem confusing it is necessary to so identify these relationships because in taking a golf stance with respect to striking a golf ball, the inner left outside, ILO of the left shoe and inner right outside IRO of the right shoe are substantially facing each other.

In the right shoe the sole 12 is precisely the same plan configuration as the sole 14 of the left shoe. However the material of the sole on the right shoe is beveled downwardly and inwardly along the inner right outside as at 22. This bevel or rounding of the sole material extends from the toe to approximately the center of the heel at the rear. Since the sole material 12 varies in thickness from the toe to the heel in a horizontal plane in order to provide a continuous arch support the bevel will be greater or less in height according to the thickness of the sole material but at the same overall angle. The outer shoe structure of the right shoe is normal to any other right shoe except that it must contain a negative or flat heel and provide sufficient comfort as to the appropriate foot size for the player. On the inside of the shoe on the inner right inside IRI, the shoe is provided with a padding 23 substantially coextensive with the entire inner right inside IRI. It is in the form of a yielding fillet to afford occasional resilient pressure from the foot.

Figure 6:
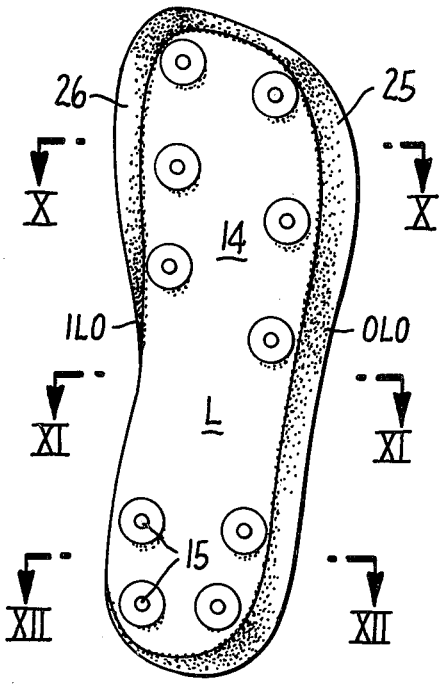
FIG. 6 is a bottom plan view of the sole of the left golf shoe.
Figure 7:
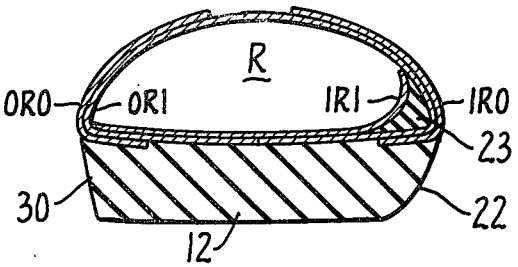
FIG. 7 is a transverse vertical sectional view of the right golf shoe taken on the line VII—VII of FIG. 5 looking in the direction of the arrows, sans spikes.
Figure 10:
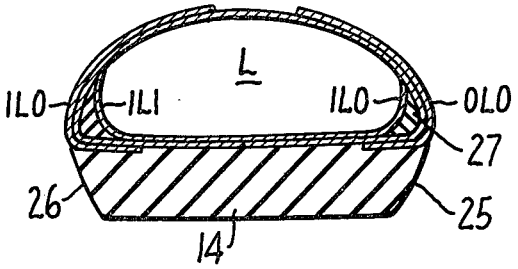
FIG. 10 is a transverse vertical section of the left shoe taken on the line X—X of FIG. 6, looking in the direction of the arrows, sans spikes.
Figure 8:
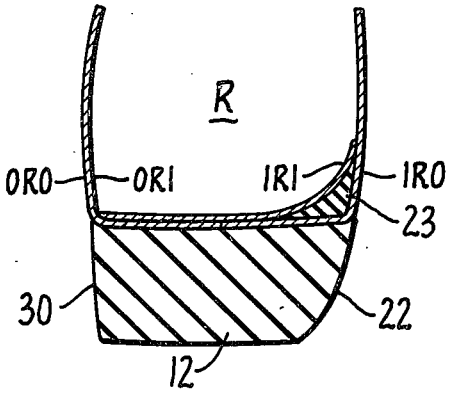
FIG. 8 is a transverse vertical section of the right golf shoe taken on the line VIII—VIII of FIG. 5 looking in the direction of the arrows, sans spikes.
Figure 11:
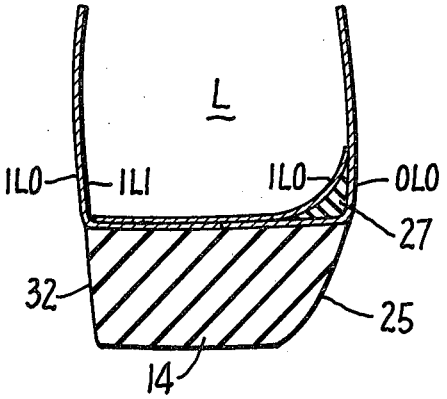
FIG. 11 is a transverse vertical section of the left shoe taken on the line XI—XI of FIG. 6, looking in the direction of the arrows, sans spikes.
Figure 9:
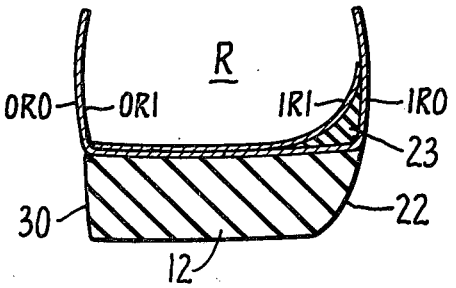
FIG. 9 is a transverse vertical section taken through the heel of the right shoe on line IX—IX of FIG. 5, sans spikes.
Figure 12:
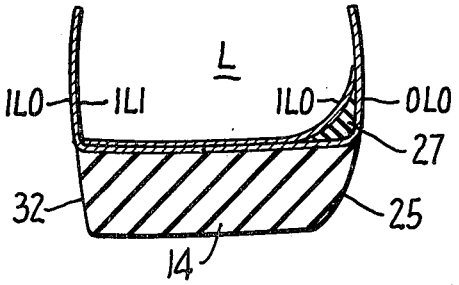
FIG. 12 is a transverse vertical section taken on the line XII—XII of FIG. 6, looking in the direction of the arrows, sans spikes.
Figure 13:
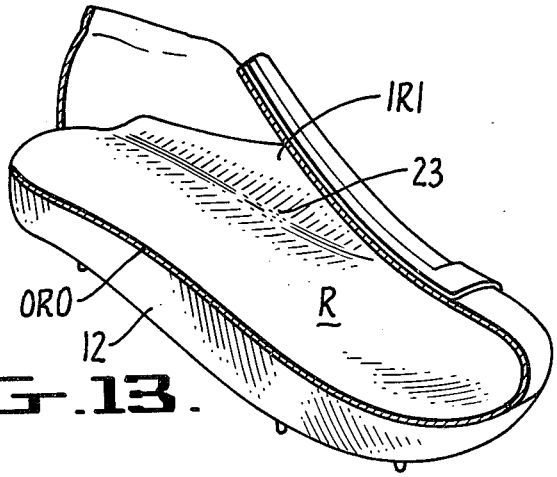
FIG. 13 is a cutaway section of the right shoe showing the location of the padding on the inside at IRI.

As will be observed from FIG. 6 the sole 14 of the left shoe is beveled continuously at 25 along the outer left outside OLO from toe to heel. This is to be contrasted with the beveling of the sole on the right shoe. It is also beveled along the inner left ouside 26 of the sole.

In the left shoe there is padding along the entire length from toe to heel on the outer left inside OLI at 27.

The structure of the right shoe provides a rolled portion of the sole from toe to heel along the inner right outside IRO and a naturally squared off section on the outer right outside as at 30. On the inside of the right shoe a cushioned fillet 23 extends from toe to heel along the inner right inside, IRI. As for the left shoe the rolled portion of the sole 14 OLO extends as at 25 from the toe to heel. Also there is a rolled or beveled portion 26 along the sole 14 ILO until it reaches the arch support 31 when the roll stops and the sole becomes squared off in the normal fashion at 32.

Figure 2:
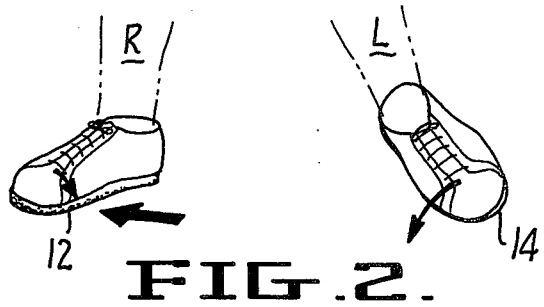
FIG. 2 is similar to FIG. 1 but illustrates the foot position in making the back swing.
Figure 3:
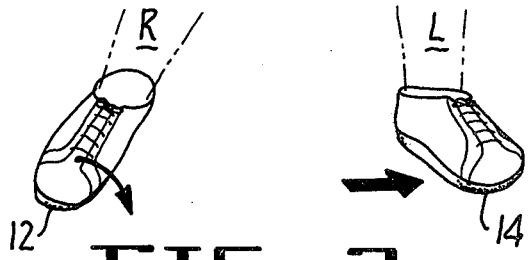
Figure 4:
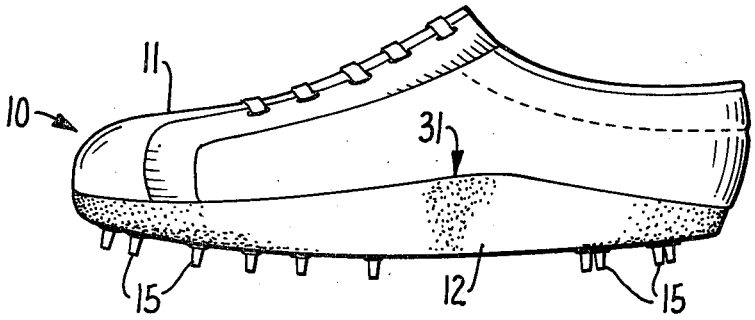
FIG. 4 is a side elevational view of the left golf shoe.

It is important to know that in addressing the ball such as shown in FIG. 1, the feet are spread apart and the feet rest comfortably on the flat portion of the soles 12 and 14. The weight of the golfer is located over his heels, where it is much easier to maintain balance for a proper swing. In starting the back swing the head does not move but there is a turn of the body particularly at the shoulders and the waist of the player. The weight is transferred to the right foot and the bevel 22 on the right shoe permits the golfer to place physical pressure against the beveled portion 22 of the sole for wedgelike leverage. In other words on the back swing the pressure is placed against the bevel 22 IRO, so that the player's upper body turn is actually pushing against this leverage (See FIG. 2). On the down swing of the stroke the push is still on the inner edge bevel 22 IRO of the right foot which gives the stroke the power required. This power leverage continues to the moment of impact and shortly thereafter when the weight is transferred to the left leg and foot (See FIG. 3). The left foot rolls over toward the outside onto the bevel 25 OLO, as indicated in FIG. 3. The bevel or curve 25 gives a larger area of support to the left foot in making this roll and greatly aids in the movement of the feet with respect to the weight transfer of the body in making a golf swing. The padding fillet 27 and the bevel 25 speed the turning movement of the left foot. This induces more club head speed through the hitting area and makes the entire body movement easier and more natural.

Painful callouses develop because of the movement of the foot within the shoes in making these various weight transfers required of every golf swing. The greatest pressures develop on the inner right inside IRI and the outer left inside OLI. Accordingly, padding 23 is provided on this portion of the right shoe, and the portion 27 of the left shoe. The cushioning being resilient keeps the foot from crowding down or slipping into the narrow portion of the inner surface and supports the inner right side of the foot and the outer left side of the foot from the abnormal pressure of the weight transfer.

As mentioned earlier, the golf shoes disclosed herein have an unusual disposition of spikes, using ten only for each shoe instead of the usual eleven. The arrangement shown herein gives stable footing under all pressure positions and better balance without having the single spike adjacent the toe of the shoe. It is this single spike which usually causes accidents, causes stumbling and falling, and catches in all manner of unnoticed objects. While the elimination of one spike per each shoe seems almost minimal, nevertheless in addition to the safety and comfort reduces the weight which is carried around. It is to be noted that the six spikes on the sole are arranged on each shoe so that the top inner spike is approximately under the great toe. While the outer three spikes in each instance are spaced further apart than the inner three spikes, the arrangement in the group is staggered. All of this is completely different from the conventional distribution of spikes. The unique arrangement cooperates with and in addition to the benefits derived from the improved golf swing.

Accordingly the shoes of this invention are designed specifically not only to aid in obtaining a proper golf swing but in doing so to prevent any undue pain or development of foot ailments as the result of making the golf strokes repeatedly.

It is believed that all of the advantages claimed for this invention have been achieved by this structure as well as many incidental advantages which are inherent in the structure.

We claim:

1. A pair of golf shoes wherein the shoes are adapted to contribute in cooperation to a proper golf swing every time, each shoe having a negative heel, and full sole from toe to heel, of conventional outline, the sole of the right shoe being beveled inwardly and downwardly along the entire length on the inner edge of the right outside and the sole of the left shoe beveled inwardly and downwardly along the toe portion on the inner edge of the left outside and also beveled along the entire length from toe to heel along the outer edge of the left outside, fillet padding along the inner right inside, and in the left shoe along the outer left inside and also in the toe portion only of the inner left inside, and each of said shoes having ten spikes on the soles arranged six each in the upper sole portion and four each in the heel portion.

2. The pair of golf shoes as in claim 1 wherein the soles are of conventional outline and wherein the spikes are arranged in two longitudinal rows of three each on the upper sole portion, with the top inside spike being positioned under the location of the great toe and the two rows are in staggered relation with the spikes of the inner row being closer together than the spikes of the outer row.

3. A right golf shoe for a right handed golfer, in combination, a conventional upper with a continuous sole from toe to heel, and having a negative heel, said sole having a continuous inward and downward bevel from toe to heel, and an inner padded fillet along the inner right juncture of the upper and sole.

4. The right golf shoe of claim 3 wherein the sole is provided with ten spikes, four in the heel portion and six in the upper sole portion, said spikes in the upper sole portion being arranged in two rows of three each, with the top inner spike located under the great toe, said rows being staggered with respect to the said top spike, and the spikes of the outer row being wider spaced than the inner row.

5. The golf shoe of claim 3 wherein the padded fillet is made permanently integral with the shoe, and the sole is made substantially flat on the bottom side with a formed arch support above.

6. A left golf shoe for a right handed golfer having a conventional upper and a continuous sole from toe to heel said shoe having a negative heel, a continuous downward and inward bevel on said sole on the inner side of the sole for about half the distances of the sole and adjacent the upper portion of the sole, around the toe thereof and down the outer left outer side and around the extremity of the heel and inner padded fillets along the inner juncture of the upper and the sole on the inner left outside and along the inner left inside substantially coextensive with the bevel of the sole on the outside.

7. The left golf shoe of claim 6 wherein the sole is provided with ten spikes, four in the heel portion and six in the upper sole portion, said spikes in the upper sole portion being arranged in two rows of three each, with the top inner spike located under the great toe, said rows being staggered with respect to the said top spike, and the spikes of the outer row being wider spaced than the inner row.

8. The left golf shoe of claim 6 wherein the padded fillet is made permanently integral with the shoe, and the sole is made substantially flat on the bottom side with a formed arch support above.

* * * * *